United States Patent [19]

Naka

[11] 4,098,024

[45] Jul. 4, 1978

[54] ACCESS DOOR

[76] Inventor: Hiromitsu Naka, No. 39, Oaza Shinmachi, Yashio-shi, Saitama-ken, Japan

[21] Appl. No.: 701,027

[22] Filed: Jun. 29, 1976

[30] Foreign Application Priority Data

| | | | |
|---|---|---|---|
| Jul. 2, 1975 | [JP] | Japan | 50-80959 |
| Jul. 2, 1975 | [JP] | Japan | 50-91631[U] |
| Jul. 14, 1975 | [JP] | Japan | 50-85307 |

[51] Int. Cl.[2] ..... E05D 15/40

[52] U.S. Cl. ..... 49/246; 49/380; 49/398; 49/501

[58] Field of Search ..... 49/398, 402, 246, 248, 49/249, 261, 380, 501

[56] References Cited

U.S. PATENT DOCUMENTS

| | | | |
|---|---|---|---|
| 1,871,342 | 8/1932 | Potter | 49/398 X |
| 3,302,331 | 2/1967 | Sturm et al. | 49/398 X |
| 3,950,894 | 4/1976 | Dimalo | 49/501 |

*Primary Examiner*—Philip C. Kannan

*Attorney, Agent, or Firm*—Wenderoth, Lind & Ponack

[57] ABSTRACT

An access door for installation in a rough opening formed in a building ceiling or wall including an outer framework having an opening adapted to be fitted in the rough opening and secured to the ceiling or wall, a cover for opening and closing the opening in the outer framework, and link hinges for pivotally connecting the cover to the outer framework, whereby when the cover is released, the cover has imparted a vertical descent movement thereto. Rapid opening and closing pivotal movement of the cover by gravity is controlled, and the opening angle of the cover can be made great.

11 Claims, 24 Drawing Figures

ACCESS DOOR

BACKGROUND OF THE INVENTION

This invention relates to an access door adapted to be installed on a building ceiling or wall for facilitating inspection and/or repair of facilities such as wiring, piping and air ducts installed within the building ceiling or wall.

When the access door is designed to be installed in a building ceiling, for example, the access door includes an outer framework adapted to be fitted in a rough opening formed in the ceiling and secured to the ceiling, a cover pivotally connected to the outer framework by means of link hinges for opening and closing the opening in the outer framework, and lock means for locking the cover to the outer framework to hold the cover in the closed position.

In an access door having the above-mentioned construction, the cover is pivotally connected to the outer framework by means of invisible hinges or concealed spring hinges or through the intermediary of a rotary shaft by means of hinges.

However, when invisible or concealed spring hinges are employed in the access door, since the hinges are secured to the outer framework and cover by means of screws so that the pins of the hinges will be positioned outside of the outer framework, portions of the concealed spring hinges tend to make contact with wiring, piping, air ducts and the like facilities positioned within the ceiling, that is between the floor of one building story and the ceiling of the story positioned right below the first-mentioned story to interfere with the cover in the opening and closing movement thereof. This could lead to the occurrence of fire due to electric leakage. On the other hand, when rotary shafts are employed in the access door, a clearance is provided between the outer framework and cover so that the cover may rotate for the opening and closing operation, and a recess is formed in the inner surface of the outer framework so that the cover may be raised above the lower end of the outer framework or the plane of the ceiling.

As the result, a conventional access doors have encountered difficulties in the provision of an air-tight arrangement employing an air-tight seal member or members between the outer framework and cover and an arrangement in which the peripheral edge of the opening in the outer framework is covered by the peripheral edge of the cover to thereby preclude the clearance defined between the outer framework and cover from being exposed.

SUMMARY OF THE INVENTION

Therefore, one object of the present invention is to provide an access door in which when the door is opened and closed, the cover moves vertically and also pivots relative to the outer framework, and the cover may assume a relatively great angle with respect to the outer framework.

Another object of the present invention is to provide an access door in which when the door is installed in a building ceiling, rapid pivotal descent movement of the cover by gravity when the cover is released is controlled, whereby the pivot pins, outer framework and/or cover can be protected against possible damage.

Another object of the present invention is to provide an access door in which when the door is closed, an air-tight seal can be maintained between the outer framework and cover and the clearance between the outer framework and cover framework is covered by the peripheral edge of the cover to thereby give a pleasing appearance to the door.

A further object of the present invention is to provide an access door which is light in weight and less expensive and which can be easily finished with a three-dimensional design substantially similar to that of the surface finish on a building ceiling.

BRIEF DESCRIPTION OF THE DRAWINGS

The above and other objects and advantages of the present invention will be more readily apparent from the following description when read in connection with the accompanying drawings.

DETAILED DESCRIPTION OF THE INVENTION

Figure 1:
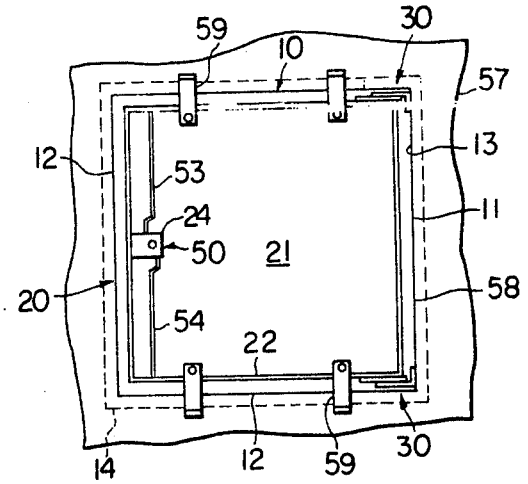
FIG. 1 is a plan view of a preferred embodiment of an access door constructed in accordance with the invention showing the same as being installed in a building ceiling.

Referring to FIGS. 1 through 4 of the accompanying drawings, one preferred embodiment of an access door having a regular square configuration according to the present invention is generally shown by 10 and illustrated as being installed in a building ceiling. The access door 10 is an assembly having a regular square configuration as seen in plan and includes a regular square outer framework 11 having a regular square opening 13 fitted in a correspondingly shaped rough opening 58 formed in a building ceiling 57 and secured to the ceiling 57 by means of fixtures 59, a regular square pivotal cover 20 for opening and closing the opening 13 in the outer framework 11, a pair of link hinges 30 for pivotally connecting the cover 20 to the outer framework 11 and a cremone locking means 50 for locking the cover 20 to the outer framework 11 when the cover 20 closes the opening 13 in the outer framework 11.

The outer framework 11 has been assembled by screwing four similar elongated aluminum outer framework elements, which may be extruded, drawn or similarly processed elements, together with corner members (not shown) interposed between the adjacent and opposed ends of the framework elements.

The thus assembled outer framework 11 has an outwardly extending peripheral flange 14 at the lower end and an inwardly extending peripheral flange 15 at the upper end, respectively.

The outwardly extending peripheral flange 14 at the bottom end of the outer framework 11 may be replaced by an inwardly extending peripheral flange at the outer framework bottom end without departing the spirit of the present invention.

The cover 20 comprises a regular square cover plate 21 and a regular square cover framework 22 integrally welded at the lower end thereof to the upper surface of the cover plate 21 at a position spaced inwardly of the peripheral edge of the cover plate 21 so as to form an outer peripheral flange 23 about the cover framework 22.

The link hinges 30 are respectively disposed about the opposed corners of the cover framework 22 on the base or pivoted side of the cover 20 within the outer framework 11 so that the cover 20 is allowed to move vertically and to pivot.

The link hinges 30 each comprise a bracket 31 for securing the link hinge to the outer framework 11, a shorter upper link 32, a longer lower link 33 parallel to and spaced from the shorter link 32 and a substantially L-shaped follower link 34 which comprises a shorter upright leg 35 and a longer horizontal leg 36.

One end of the upper shorter link 32 is pivoted to an upper position of the bracket 31 by means of a pivot pin 40, and the other end of the upper shorter link is pivoted to an upper position of the upright leg 35 of the L-shaped follower link 34 by means of a pivot pin 41. The longer lower link 33 has one end pivoted to the bracket 31 at a position spaced from and below the pivot point of one end of the upper link 32 by means of a pivot pin 42, and link 33 is pivoted at a midway position thereof to the upright leg 35 of the L-shaped follower link 34 at a position thereon below the pivot point of the other end of the shorter upper link 32 by means of a pivot pin 43. The portion of link 33 extending from the midway pivot point to the other or leading end of the longer lower link 33 is formed as a guide portion 39 by means of which the link hinge 30 is smoothly guided to the stowage position as the cover 20 is pushed upwardly from the open position when the opening 13 in the outer framework is closed.

Provided at one end of the longer horizontal leg 36 of the follower link 34 is an extension 37 which extends downwardly by a distance corresponding to the width of the horizontal leg 36 and is pivoted by means of a pivot pin 44 to an abutment plate 38 which is in turn welded to the outer surface of the cover framework 22.

The cremone locking means 50 comprises a rotary drum 51 mounted in a support plate 24 fixedly secured to the cover framework 22 on the unpivoted side of the cover 20, an operation plate 52 fixedly secured to the rotary drum 51 and a pair of bars 53, 54 extending from the opposite ends of the operation plate 52. The free end of each of the bars 53, 54 is, of course, adapted to extend through a corresponding guide hole (not shown) formed in the cover framework 22 and normally fits in a corresponding bar receiving hole (not shown) formed in the outer framework 11.

Figure 2:
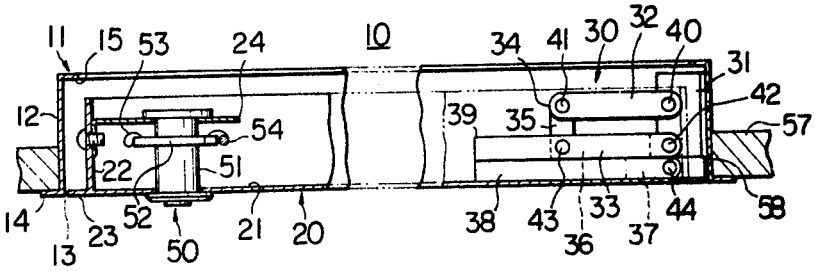
FIG. 2 is an enlarged cross-sectional view taken through a portion of FIG. 1.
Figure 3:
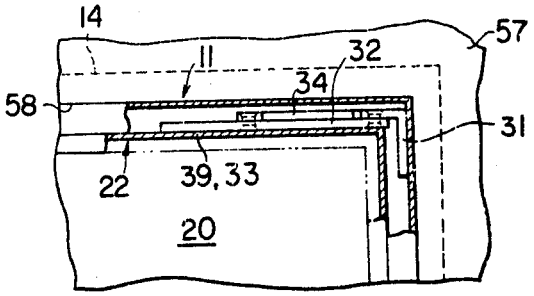
FIG. 3 is a fragmentary plan view especially showing one of the link hinges employed in the access door as shown in FIG. 1.
Figure 4:
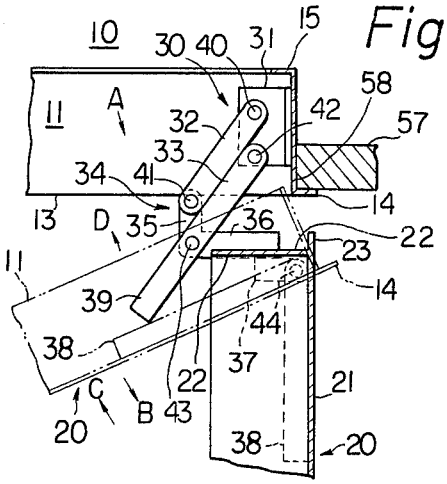
FIG. 4 is a fragmentary cross-sectional view of the embodiment of FIGS. 1 through 3 showing the door in its open position.

When the cover 20 of the access door 10 is desired to be opened, as shown in FIGS. 2 and 4, first of all, the rotary drum 51 is rotated to pull the free ends of the bars 53, 54 out of the respectively associated bar receiving holes to thereby unlock the lock means 50. When the lock means 50 is unlocked, the cover 20 is allowed to descend by gravity.

As the cover 20 descends, the parallel links 32, 33 pivot about their pivot pins 40, 42, respectively to cause the link hinges 30 to rotate in the direction of arrow A as seen in FIG. 4 because the cover 20 is pivoted to the follower link 34 by means of the pivot pin 44.

As the parallel links 32, 33 begin to pivot downwardly, the cover 20 rotates about the pivot pin 44 in the direction of arrow B as seen in FIG. 4 because the unpivoted or leading end of the lower link 33 strikes against the upper surface of the abutment plate 38 to deliver a downward movement to the cover 20.

As the parallel links 32, 33 continue to pivot about the pivot pins 40, 42, respectively, until the undersurface of the upper link 32 makes contact with the upper surface of the lower link 33, the downward pivotal movement of the parallel links 32, 33 and in consequence, the downward pivotal movement of the link hinges 30 is arrested and as a result, the cover 20 is released to pivot to the vertical position as seen in FIG. 4.

When the cover 20 is desired to be moved from the open position to the closed position, the cover 20 is pushed upwardly in the direction of arrow C. Thus, the cover 20 is pivoted upwardly about the pivot pin 44 until the upper surface of the abutment plate 38 makes contact with the undersurface of the kick or guide portion 39 of the lower link 33. Thereafter, as the cover 20 is further pivoted upwardly about the pivot pin 44, the lower link 33 is pivoted about the pivot pin 42 whereby the cover 20 is pushed upwardly in the direction of arrow D as seen in FIG. 4. As the lower link 33 pivots upwardly, the upper link 32 connected to the lower link 33 through the follower link 34 is also pivoted upwardly about the pivot pin 40.

In this way, as the link hinges 30 are pivoted upwardly, the cover 20 is moved into the opening 13 in the outer framework 11 to close the opening 13. Thereafter, the lock means 50 is locked to hold the cover 20 in the closed position.

Figure 5:
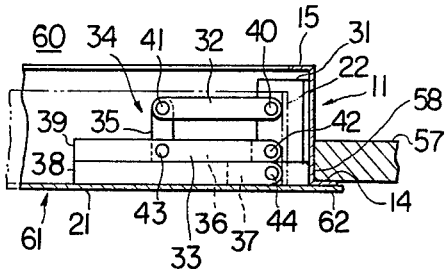
FIG. 5 is a fragmentary cross-sectional view of a modified embodiment of an access door of the present invention in which the edge of the opening in the outer framework is covered by the peripheral edge of the cover.
Figure 6:
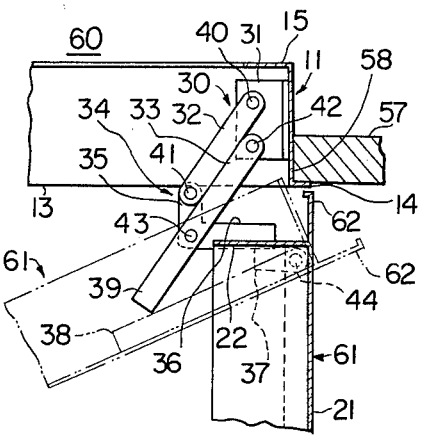
FIG. 6 is a fragmentary cross-sectional view of the embodiment as shown in FIG. 5 showing the access door in its open position.

FIGS. 5 and 6 show a modified and preferred embodiment of access door 60 of the invention, and this access door 60 includes a modification of the cover 20. The parts of the access door 60 which correspond to those of the first embodiment are assigned the corresponding numerals thereto.

The periphery of the cover 61 of the access door 60 extends along the undersurface of the outwardly extending peripheral flange 14 of the outer framework 11 to form an outwardly extending peripheral flange 62 which covers the flange 14. Thus, since the opening and closing operation of the modified cover 61 is the same as described in connection with the cover 20 of the above-mentioned access door 10, description of the operation of the modified cover is omitted herein. Especially, when the cover 61 is opened and closed, since the cover 61 is moved downwardly and upwardly by means of the link hinges 30, and cover 61 is smoothly opened and closed without causing the outwardly extending peripheral flange 62 of the cover to engage the outwardly extending peripheral flange 14 of the outer framework 11.

Figure 7:
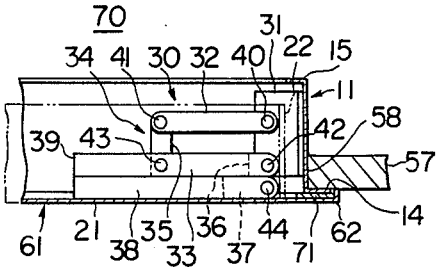
FIG. 7 is a fragmentary cross-sectional view of a further modified embodiment of the present invention in which an air-tight seal arrangement is provided between the outer framework and cover.

FIG. 7 shows a further modified and preferred embodiment of access door 70 of the invention and this access door 70 includes an air-tight seal member 71 interposed between the outwardly extending peripheral flange 14 of the outer framework 11 and the outwardly extending peripheral framework 62 of the cover 61 in the access door 60 of FIG. 5, and the parts of this embodiment 70 which correspond to those of the preceding embodiments are assigned the corresponding numerals thereto.

The air-tight seal member 71 is formed of a resilient material such as rubber, synthetic resin or a foam material thereof and has a regular square configuration. Thus, when the cover 61 is closed, an air-tight seal is maintained between the outer framework 11 and cover 61. The opening and closing operation of the access door 70 is the same as that of the access door 60.

Figure 8:
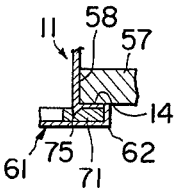
FIGS. 8 and 9 are fragmentary cross-sectional views of modified air-tight seal arrangements.
Figure 9:
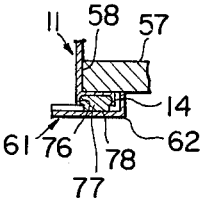

FIGS. 8 and 9 show modifications of the air-tight seal arrangement of the access door 70 shown in FIG. 7. In the air-tight seal arrangement of FIG. 8, the lower end of the outer framework 11 is integrally formed with an annular projection 75 having an acutely angled cross-section, and when the cover 61 is closed, the projection 75 intrudes into the annular air-tight seal member 71 secured to the upper surface of the outwardly extending peripheral flange 62 of the cover 61 to improve the air-tight sealing between the outer framework 11 and cover 61.

In the air-tight seal arrangement of FIG. 9, the undersurface of the outwardly extending peripheral flange 14 of the outer framework 11 is formed with an annular groove 76 having a regular square cross-section and an annular air-tight seal member 77 is fitted in the annular groove 76. The undersurface of the air-tight seal member 77 is integrally formed with a plurality of spaced ridges 78, and when the cover 61 is closed, a satisfactory air-tight sealing is provided between the outer framework 11 and cover 61. The air-tight seal arrangement of FIG. 9 facilitates the replacement of the air-tight seal member 77.

Each of the air-tight seal members 71 and 77 of FIGS. 7 through 9 may be, of course, disposed between the inwardly extending peripheral flange 15 of the outer framework 11 and the upper end of the cover framework 22 of the cover 20 or 61 within the scope of the invention.

Figure 10:
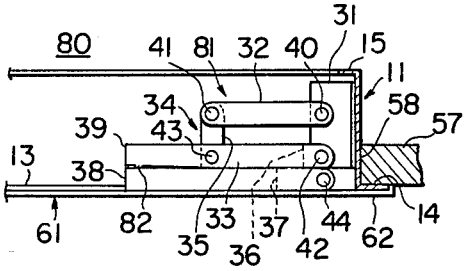
FIGS. 10 through 15 are fragmentary cross-sectional views of modified embodiments of the invention in which modified link hinges are employed.

FIG. 10 shows a further modified and preferred embodiment of access door 80 of the invention, and the access door 80 employs a modification of the link hinges 30 in the access door 60 of FIG. 5. The parts of the access door 80 which correspond to those of the access door 60 are assigned the corresponding numerals thereto.

In each of the link hinges 81 of the access door 80, the kick or guide portion 39 of the lower longer link 33 is formed on the undersurface thereof with an arcuate projection 82 extending downwardly from the undersurface of the link by a small distance.

As shown in FIG. 10, when the cover 61 is closed, the side of the cover 61 where the cremone locking means is provided or the unpivoted side of the cover is in a slightly opened position.

After the cover 61 has been further pushed up from the slightly opened position, the cover 61 is locked to the outer framework 11 by means of the cremone locking means. Thus, the cover 61 satisfactorily closes the opening 13 in the outer framework 11 without leaving any clearance between the outer framework 11 and cover 61 regardless of the preciseness of the link hinges 81.

Figure 11:
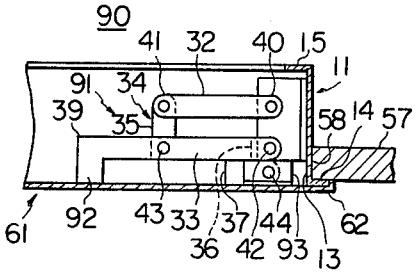

FIG. 11 shows a further modified and preferred embodiment of access door 90 of the invention, and the access door 90 employs a modification of the link hinges 30 of the access door 60 and eliminates the abutment plates 38. The parts of the access door 90 which correspond to those of the access door 60 are assigned the corresponding numerals thereto.

Each of the link hinges 91 of the access door 90 has a projection 92 extending downwardly from the undersurface of the kick or guide portion 39 of the lower longer link 33. The projection 92 has a height sufficient to maintain the lower link 33 in its horizontal position by contact with the upper surface of the cover 61 when the cover is closed. More particularly, the projection 92 extends from the undersurface of the lower link 33 by a distance corresponding to the width of the abutment plate 38.

One end of the longer leg of the follower link 34 in the link hinge 91 is pivoted by means of the pivot pin 44 to a bracket 93 secured to the outer surface of the cover framework 22 of the cover 61. The opening and closing operation of the cover 61 in the access door 90 is the same as that of the door in the access door 60.

Figure 12:
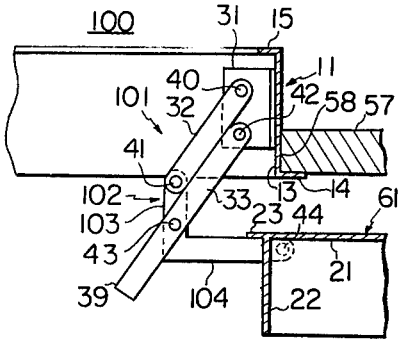

FIG. 12 shows a further modified and preferred embodiment of access door 100 of the invention, and the access door 100 employs a modification of the link hinges 30 in the access door 60 and eliminates the abutment plates 38. The parts of the access door 100 which correspond to those of the access door 60 are assigned the corresponding numerals thereto.

Each of the link hinges 101 in the access door 100 includes a modified substantially L-shaped follower link 102, and the length of the lower portion of the upright leg 103 of the follower link 102 extending downwardly from the pivot point to the lower longer link 33 is made longer than that of the upright leg 35 of the follower link 34 in the preceding embodiments so that the horizontal longer leg 104 of the follower link 102 is positioned in a further lower position by a distance corresponding to the width of the abutment plate.

Furthermore, in the link hinge 101, the outer end of the horizontal longer leg 104 of the follower link 102 is pivoted to the cover framework 22 of the cover 61 by means of the pivot pin 44.

Thus, when the cover 61 of the access door 100 is released, the cover 61 is allowed to descend by gravity until the guide portions 39 of the lower longer links 33 of the link hinges 101 make contact with the outwardly extending peripheral flange 62 of the cover 61 and as the cover 61 continues to descend by gravity, the cover 61 pivots about the pivot pin 44 in the opening direction.

Figure 13:
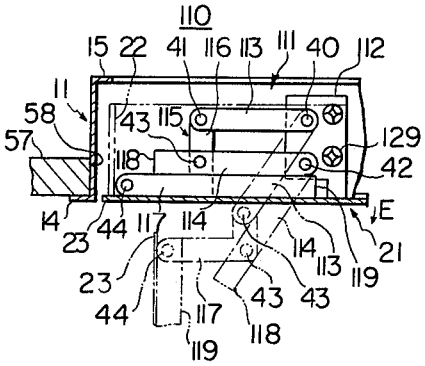

FIG. 13 shows a further modified and preferred embodiment of access door 110 of the invention, and the access door 110 employs a modification of the link hinges 30 in the access door 60 of FIG. 5. The parts of the access door 110 which correspond to those of the access door 60 are assigned the corresponding numerals thereto.

In each of the link hinges 111 of the access door 110, the bracket 112 is secured to the inner surface of the outer framework 11 adjacent the left-hand side (as seen in FIG. 13) of the cover by means of screws 129.

The upper link 113 is pivoted at one end thereof to an upper position of the bracket 112 by means of the pivot pin 40 and at the other end thereof to an upper position of the shorter upright leg 116 of the L-shaped follower link 115 by means of the pivot pin 41, and the lower longer link 114 is parallel to and suitably spaced from the upper shorter link 113 and pivoted at one end thereof to a position of the bracket 112 below the pivot point of the one end of the upper link by means of the pivot pin 42, and at the other end thereof to the upright leg 116 of the follower link 115 by pivot pin 43 a position below the pivot point 41 of the other end of the upper link 113. The portion of the lower longer link 114 which extends leftwards from the pivot point 43 to the free end thereof is formed as a kick or guide portion 118 which is adapted to impart a forced pivotal movement to the cover 61 when the cover is released. The free end or left end (as seen in FIG. 13) of the kick portion 118 is suitably positioned midway between the pivot point 44 of the horizontal leg 117 of the follower link 115 to the cover 61 and the pivot point 43 of the lower link 114 to the follower link upright leg 116.

The horizontal leg 117 of the follower link 115 is also pivoted to the cover 61 by means of the pivot pin 44. More particularly, the horizontal leg 117 of the follower link 115 is pivoted, at the free or left end thereof, by pivot pin 44 to the abutment plate 119 welded to the outer surface of the cover framework 22. It will be, of course, noted that when the cover 61 is closed, the lower link 114 is disposed on the upper surface of the abutment plate 119.

Thus, in the access door 110, when the cover 61 is desired to be opened, the cremone locking means is first released whereupon the cover 61 is allowed to begin its descent movement by gravity. As the cover 61 begins its descent movement, the follower links 115 of the link hinges 111 begin their descent movement.

As the follower links 115 begin their descent movement, the upper and lower links 113, 114 of the link hinges 111 begin their pivotal movement relative to the brackets 112. When the kick portions 118 of the lower links 114 strike against the upper surface of the abutment plates 119 as the upper and lower links pivot relative to the brackets 112, the cover 61 pivots about the pivot pins 44 in the direction of arrow E as seen in FIG. 13.

Figure 14:
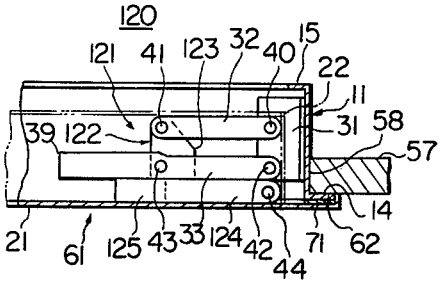
Figure 15:
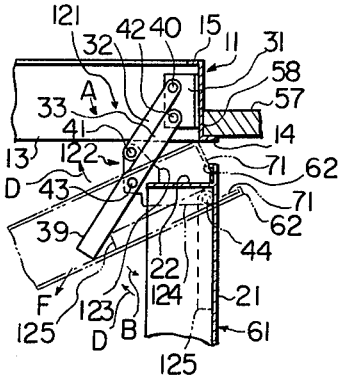

FIGS. 14 and 15 show a further modified and preferred embodiment of access door 120 of the invention, and this access door 120 is substantially similar to the access door 70 of FIG. 7 except that modified link hinges and abutment plates are provided. The parts of the access door 120 which correspond to those of the access door 70 are assigned the corresponding numerals thereto.

As more clearly shown in FIG. 15, each of the link hinges 121 of the access door 120 includes a modified substantially L-shaped follower link 122.

The L-shaped follower link 122 comprises a shorter upright leg 123 and a longer horizontal leg 124 as in the case of the follower links 34 in FIGS. 2 and 7. the horizontal leg 124 is integrally formed with the lower end of the upright leg 123 so that when the cover 61 is closed, the horizontal leg 124 lies in the same horizontal plane as a modified abutment plate 125 welded to the outer surface of the cover framework 22.

Furthermore, the horizontal leg 124 of the follower link 122 is pivoted at the outer end thereof to the abutment plate 125 by means of the pivot pin 44 and more particularly, the follower link 122 is pivoted to the cover 61 by means of the pivot pin 44.

As more clearly shown in FIG. 15, the length of the abutment plate 125 is made shorter than that of the lower link 33 of the link hinge 121.

With the above construction and arrangement of the link hinges 121 and abutment plates 125, when the cover 61 is being closed, the upper surface of the free ends of the pivoting abutment plates 125 slidably moves along the undersurface of the corresponding lower links 33 from the position adjacent the free ends toward the pivoted ends of the lower links 33 while gradually pushing the links upwardly. At this time, since the lower links 33 are pushed upwardly in a direction substantially at right angles to the direction of force F (FIG. 15) generated in the lower links 33 under the gravity of the released cover 61, the force F will not substantially act on the closing cover 61, and only a relatively low friction resistance occurs between the upper surface of the free ends of the abutment plates 125 and the undersurface of the lower links 33, whereby the cover 61 pivots smoothly about the pivot points 44 and is pulled upwardly by the link hinges 121 to the closing position.

The releasing operation of the cover 61 is effected in the same manner as in the case of the cover 61 as shown in FIG. 6.

Figure 16:
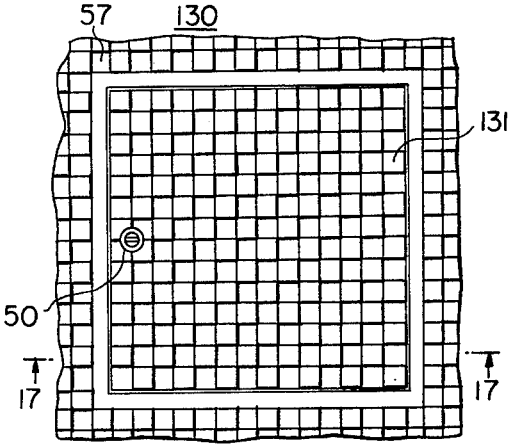
FIG. 16 is a plan view of a further modified embodiment of the invention in which the surface of the cover is finished in the same manner as the surface of the ceiling.
Figure 17:
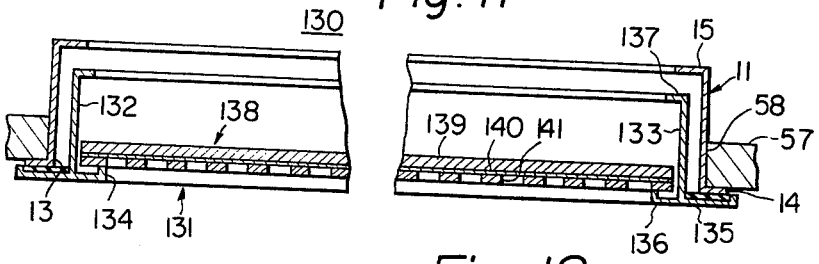
FIG. 17 is a fragmentary cross-sectional view of the cover plate taken along substantially the line 17 — 17 of FIG. 16.

FIGS. 16 and 17 show a further modified and preferred embodiment, of access door 130 of the invention and this access door 130 is substantially similar to the access door 10 of FIG. 2 except that the cover 20 of the access door 10 is modified and the remaining parts of the access door 130 which correspond to those of the embodiment of FIG. 2 are assigned the corresponding numerals thereto.

The modified cover 131 of the access door 130 has the upper surface thereof decorated with a three-dimensional design which is the same as or similar to that provided on a ceiling panel where the access door is installed.

Thus, the cover 131 comprises a cover framework 132 and a cover plate 138 which closes the opening 134 defined by the cover framework 132.

As in the case of the above-mentioned cover outer framework 11 of FIG. 11, the cover framework 132 has a regular square configuration and is formed by assembling four similar elongated aluminum framework elements 133, which may be extruded, drawn or similarly processed, together with corner members (not shown) interposed between the adjacent ends of the elements and fastened by means of screws.

Since the framework elements 133 have a cross-section as shown in FIG. 17, the assembled cover framework 132 is formed at the lower end thereof with an outwardly extending peripheral flange 135 and an inwardly extending peripheral flange 136 and at the upper end with an inwardly extending flange 137, and a cover plate 138 is secured to the inwardly extending peripheral flange 136.

The cover plate 138 has two integral superimposed film layers 140, 141 applied on a substrate plate 139 with a portion of the intermediate layer 141 exposed to the uppermost layer 140 to thereby provide a three-dimensional decorative finish to the upper surface of the cover plate 138.

The substrate plate 139 may be formed of any suitable inorganic material selected from the group comprising metal plates such as aluminum, steel and stainless plates and gypsum and flexible boards. The substrate plate is preferably formed of a metal plate because of its incombustible and high rigidity properties. When conditions such as cost and film adhesion power are taken into consideration, the substrate plate is preferably formed of an electrolytic-zinc plated steel plate.

The application of the films 140, 141 and the formation of the three-dimensional design may be carried out be either one of the following two alternative methods:

First method

This method comprises the steps of applying a dark color film principally comprising thermal setting resin (polyester) onto an electrolytic-zinc plated steel plate onto which has been preliminarily applied a primer film, baking the steel plate to form the intermediate layer 140, applying a milk-white film principally comprising thermal setting resin onto the intermediate layer 140, removing a portion of the applied second film by means of a roll engraved with the same design as that of a travertine which is most commonly used as a ceiling panel while the applied second film is still in its gelled state to form the outermost layer 141 and at the same time exposing the intermediate layer 140 to the removed areas of the outermost layer 141 to thereby provide a three-dimensional design and baking the thus treated steel plate to complete the multi-layer cover plate 138.

Second method

This method comprising the steps of applying a dark color film principally comprising thermal setting resin (polyester) onto an electrolytic-zinc plated steel plate onto which has been preliminarily applied a primer film, baking the steel plate to form the intermediate layer 140, placing a screen having the same opening design as that of a travertine onto the intermediate layer 140, applying a milk-white film principally comprising thermal setting resin onto the screen and baking the thus treated steel plate to form the outermost layer 141 to complete the cover plate 138. FIGS. 18 through 22 show cover plates 142, 144, 146, 148 and 152 having modified surface finishes which are modifications of the surface finish of the cover plate 138 of the access door 130 as shown in FIGS. 16 and 17.

Figure 18:
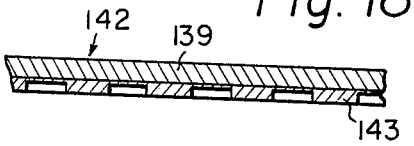
FIGS. 18 through 22 are fragmentary cross-sectional views of the cover plates having surfaces with modified finishes.

The cover plate 142 of FIG. 18 has been produced by passing a sheet 143 preheated to about 150° C between a pattern roll engraved with a three-dimensional design which is the same as that on a ceiling panel and a smooth surfaced rubber roll to emboss the design into the surface of the sheet, and applying the embossed sheet onto a substrate plate 139 comprising an electrolytic-zinc plated sheet by means of an adhesive. The material for the sheet employed in the production of the cover plate 142 is thermoplastic resin which softens easily with heat, and a preferable material is vinyl chloride.

Figure 19:
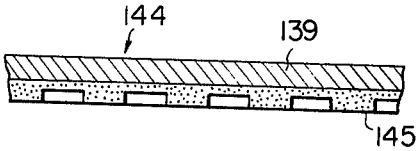

The cover plate 144 of FIG. 19 has been produced by passing a foam synthetic resin sheet 145 comprising thermoplastic resin between a heated pattern roll engraved with the same three-dimensional design as that of a ceiling panel and a rubber roll to press the foam resin layer on the sheet 145 by means of the heat and pressure provided by the pattern roll to emboss the design into the foam layer, and applying the thus treated sheet onto a substrate plate 139 comprising an electrolytic-zinc plated steel plate.

Figure 20:
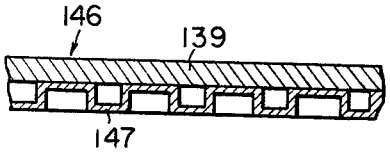

The cover plate 146 of FIG. 20 has been produced by passing a sheet 147 through male and female-type rolls to emboss a design into the opposite surfaces of the sheet, and applying the thus treated sheet onto a substrate plate 139 comprising an electrolytic-zinc plated steel plate by means of an adhesive. The material suitably employed for the sheet 147 is a semi-hard synthetic resin or paper board.

Figure 21:
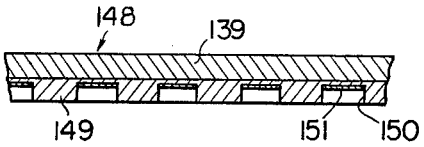

The cover plate 148 of FIG. 21 employs an embossed sheet 149 having color prints 151 within the recesses 150 in the sheet 149. The cover plate 148 has been produced by applying an ink onto convexes on a pattern roll engraved with a three-dimensional design the same as or similar to that of a ceiling panel, passing the sheet 149 between the pattern roll and a smooth surfaced rubber roll to emboss the sheet 149 and at the same time color the sheet and applying the sheet, onto a substrate plate comprising an electrolytic-zinc plated steel plate by means of an adhesive.

Figure 22:
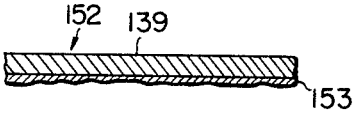

The cover plate 152 of FIG. 22 has been produced by printing a sheet 153 with a design identical with or similar to a three-dimensional design of a ceiling panel and embossing the printed surface areas of the sheet with various shapes. The cover plate 152 is employed for the purpose of enhancing the uniformity of the cover plate by giving a three-dimensional appearance to the design bearing areas of the embossed sheet or of bringing the tone of the embossed surface of the cover plate closer to that of a ceiling by matting the surface through embossing with a pattern quite different from the design. In this case, the sheet 153 may be a member selected from the group consisting of synthetic resin sheets, foam synthetic resin sheets, paper boards and asbestos sheets.

Figure 23:
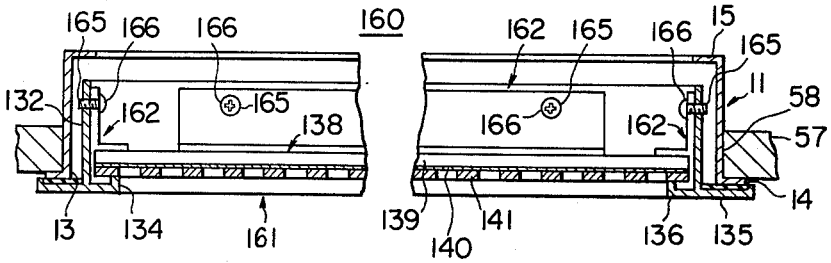
FIG. 23 is a cross-sectional view substantially similar to FIG. 17, but showing a further modified embodiment of the invention.
Figure 24:
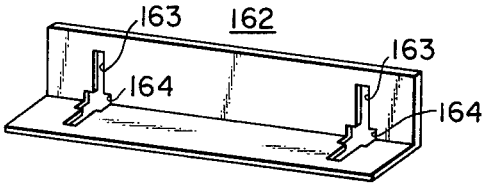
FIG. 24 is a fragmentary perspective view on an enlarged scale of one of the unequal-sided angle members employed in the embodiment of FIG. 23.

FIGS. 23 and 24 show a further modified and preferred embodiment of access door 160 of the invention, and this access door is substantially similar to the access door 130 of FIG. 17 except that a modified mounting arrangement for the cover plate 138 is employed. The parts of the access door 160 which correspond to those of the access door 130 are assigned the corresponding numerals thereto. In these Figures, the means such as the link hinges and cremone locking means are eliminated therefrom.

The cover 161 of the access door 160 includes a cover framework 132 defining an opening 134 and a cover plate 138 for opening and closing the opening 134 of the cover framework 132.

The cover plate 138 is secured to the cover framework through the intermediary of unequal-sided angle members 162 by the use of screws 165. As more clearly shown in FIG. 24, the two sides of each of the unequal-sided angle members 162 are provided with aligned elongated slide slots 163.

The adjacent or inner ends of the slide slots 163 in the two sides of the angle member 162 are in communication with each other, and provided at the juncture between the aligned slide slots 163 is a screw hole 164 having a diameter greater than that of the head 166 of the screw 165.

Thus, when the cover framework 132 is to be secured to the cover plate 138, the screws are previously and provisionally fastened to the inner surface of the cover framework 132 in predetermined positions of the cover framework and the cover plate 138 is then mounted on the inwardly extending peripheral flange 136. Thereafter, the angle members 162 are fitted on the heads 166 of the screws 165 by way of the screw holes 164 in the angle members to cause the slide slots 163 to engage the screws 165. Finally, the screws 165 are tightened with the angle members 162 maintained in abutment against the cover plate 138 during the screw tightening operation to thereby firmly secure the cover plate 138 to the cover framework 132.

It will be noted that the screw hole 164 may be, of course, provided either in the longer or shorter side of the angle member 162 instead of being provided at the juncture between the two sides of the angle member.

As a result, the upper portion of each of the angle members 162 protrudes upwardly from the cover framework 132 by a substantial distance whereby various cover plates 138 having different thicknesses can be easily secured to the cover framework 132 by the employment of the angle member 162.

While various embodiments of the invention have been shown and described in detail it will be understood that these are for the purpose of illustration only and are not to be taken as a difinition of the scope of the invention, reference being had for this purpose to the appended claims.

What is claimed is:

1. An access door comprising:

an outer framework adapted to be fitted and secured in a rough opening in a building ceiling or wall, said outer framework having therein an opening;

a cover for opening and closing said opening in the outer framework; and link hinge means positioned between said outer framework and a side of said cover for mounting said cover to said outer framework such that said cover undergoes both pivotal movement with respect to said outer framework and movement in a direction perpendicular to the plane of said opening in said outer framework during opening and closing of said opening, said link hinge means comprising a pair of link hinges, each of said link hinges including a substantially L-shaped follower link having an upright leg and a horizontal leg pivoted at a free end thereof to a corner of said cover, a shorter upper link pivoted at one end thereof to said outer framework and at the other end thereof to said upright leg of said follower link, and a longer lower link parallel to and spaced from said shorter upper link and pivoted at one end thereof to said outer framework and at an intermediate portion thereof to said upright leg of said follower link, the portion of said lower link extending from said intermediate portion thereof to the other end thereof forming an extension guide portion.

2. An access door as claimed in claim 1, wherein each said guide portion is provided on an undersurface thereof with a projection adapted to make contact with the upper surface of said cover when said access door is in the closed position thereof.

3. An access door as claimed in claim 1, further comprising a seal member provided between said outer framework and said cover.

4. An access door as claimed in claim 1, wherein each said link hinge further includes an abutment plate secured to the side surface of said cover adapted to be positioned below said longer lower link when said access door is in the closed position thereof, said abutment plate being pivoted at a first end thereof to said horizontal leg of said follower link.

5. An access door as claimed in claim 4, wherein said abutment plate is shorter than said longer lower link.

6. An access door as claimed in claim 4, wherein said longer lower link and said abutment plate have substantially the same length.

7. An access door as claimed in claim 6, wherein said guide portion has on the undersurface thereof an arcuate projection for abutting against the upper surface of said abutment plate.

8. An access door as claimed in claim 1, wherein said cover has thereon a cover plate having on the surface thereof a three-dimensional design.

9. An access door as claimed in claim 8, wherein said cover plate comprises a substrate plate, an intermediate film layer integrally applied on the surface of said substrate plate, and an outermost film layer integrally applied on the exposed surface of said intermediate layer so as to partially expose said intermediate layer.

10. An access door as claimed in claim 8, wherein said cover plate comprises a substrate plate, and a sheet integrally secured to the surface of said substrate plate and having an embossed surface.

11. An access door as claimed in claim 10, wherein said thus embossed sheet is colored.

* * * * *